US009872573B1

(12) United States Patent
Yates et al.

(10) Patent No.: US 9,872,573 B1
(45) Date of Patent: Jan. 23, 2018

(54) CONVERTIBLE BAR CABINET

(71) Applicant: A.R.T. Furniture, Inc., Ontario, CA (US)

(72) Inventors: Daniel Eric Yates, High Point, NC (US); Adam Tilley, High Point, NC (US)

(73) Assignee: A.R.T. Furniture, Inc., Ontario, CA (US)

( * ) Notice: Subject to any disclaimer, the term of this patent is extended or adjusted under 35 U.S.C. 154(b) by 0 days.

(21) Appl. No.: 15/331,358

(22) Filed: Oct. 21, 2016

(51) Int. Cl.

| | |
|---|---|
| ***A47B 96/18*** | (2006.01) |
| ***A47F 9/00*** | (2006.01) |
| ***A47B 33/00*** | (2006.01) |
| ***A47B 1/04*** | (2006.01) |
| ***A47B 13/02*** | (2006.01) |
| ***A47B 1/08*** | (2006.01) |
| ***A47B 77/02*** | (2006.01) |
| ***A47B 46/00*** | (2006.01) |
| ***A47B 69/00*** | (2006.01) |

(Continued)

(52) U.S. Cl.
CPC ..... *A47F 9/005* (2013.01); *A47B 1/04* (2013.01); *A47B 1/08* (2013.01); *A47B 13/02* (2013.01); *A47B 31/00* (2013.01); *A47B 33/00* (2013.01); *A47B 46/00* (2013.01); *A47B 69/00* (2013.01); *A47B 77/022* (2013.01); *A47B 96/02* (2013.01)

(58) Field of Classification Search
CPC .. A47F 9/005; A47B 1/04; A47B 1/08; A47B 13/02; A47B 31/00; A47B 33/00; A47B 46/00; A47B 69/00; A47B 77/022; A47B 96/02
See application file for complete search history.

(56) References Cited

U.S. PATENT DOCUMENTS

| | | | | |
|---|---|---|---|---|
| 350,414 | A * | 10/1886 | Crowley | A47C 17/62 108/13 |
| 898,778 | A | 9/1908 | Phelan | |
| 1,051,793 | A | 1/1913 | Whitaker | |

(Continued)

FOREIGN PATENT DOCUMENTS

| | | |
|---|---|---|
| EP | 1222887 | 7/2002 |
| WO | 1994/15824 | 7/1994 |

OTHER PUBLICATIONS

Homecraft "Hampshire Isle" Kitchen Island Cabinet with Pass through drawers; As found at website: http://salestores.com/homecr01.html#.VwLC7U1rJhE; known at least as early as Apr. 4, 2016, 2 pgs.

(Continued)

*Primary Examiner* — Hanh V Tran
(74) *Attorney, Agent, or Firm* — Womble Bond Dickinson (US) LLP

(57) ABSTRACT

Furniture with an extensible counter-top is described. The extensible counter-top has a primary surface and a pair of leaves hingeably attached to the cabinet housing for pivoting relative to the primary surface. In a folded position, the pair of leaves rest upon the primary surface. In an unfolded position, the pair of leaves pivot in opposite directions to expand a width of the counter-top. When in the unfolded position, a first leaf of the pair of leaves forms a first support surface substantially coplanar with the primary surface, and a second leaf of the pair of leaves forms a second support surface offset below the primary surface.

12 Claims, 6 Drawing Sheets

(51) Int. Cl.
*A47B 31/00* (2006.01)
*A47B 96/02* (2006.01)

(56) References Cited

U.S. PATENT DOCUMENTS

| | | | | | |
|---|---|---|---|---|---|
| 1,295,438 | A | | 2/1919 | Cordray | |
| 1,363,062 | A | | 12/1920 | Steere | |
| 1,452,117 | A | | 4/1923 | Holmes | |
| 1,582,346 | A | * | 4/1926 | Oster | F24C 1/16 108/29 |
| 1,858,857 | A | * | 5/1932 | Huntley | A47B 1/04 108/101 |
| 1,913,387 | A | | 6/1933 | Hayward | |
| 2,319,613 | A | | 5/1943 | Lichtstern et al. | |
| 2,603,500 | A | * | 7/1952 | Messier | A47B 31/00 108/77 |
| 2,675,288 | A | * | 4/1954 | Usher | A47B 17/036 108/9 |
| 2,725,274 | A | | 11/1955 | Stivale | |
| 2,812,227 | A | * | 11/1957 | Hill | A47B 69/00 297/188.1 |
| 3,087,767 | A | * | 4/1963 | Schell | A47B 85/08 312/239 |
| 3,340,827 | A | | 9/1967 | Sims | |
| 3,672,741 | A | | 6/1972 | Clark | |
| 3,983,583 | A | * | 10/1976 | Herman | A47B 69/00 312/140.2 |
| 3,993,376 | A | * | 11/1976 | Meldahl | A47B 77/06 312/22 |
| 4,161,234 | A | * | 7/1979 | Munn | A47B 31/00 186/52 |
| 4,592,603 | A | | 6/1986 | Adams et al. | |
| D373,688 | S | | 9/1996 | Tulli | |
| D383,341 | S | | 9/1997 | Grosfillex | |
| D401,438 | S | | 11/1998 | Acinapura et al. | |
| 6,561,599 | B2 | | 5/2003 | Itakura | |
| 6,766,747 | B1 | * | 7/2004 | Wolfe | A47B 13/081 108/26 |
| D584,073 | S | | 1/2009 | Mohundro | |
| 2006/0005747 | A1 | * | 1/2006 | Cartelli | A47B 1/08 108/65 |
| 2006/0016372 | A1 | * | 1/2006 | Younse | A47B 21/0314 108/44 |
| 2009/0121593 | A1 | * | 5/2009 | Greiner | A47B 46/00 312/224 |
| 2012/0097077 | A1 | * | 4/2012 | Surinlert | A47B 1/08 108/77 |
| 2014/0331903 | A1 | * | 11/2014 | Massimini | A47B 13/088 108/64 |

OTHER PUBLICATIONS

American Heritage Evolution Bar Cabinet with Wine Storage; As found at website: http://www.sears.com/american-heritage-evolution-bar-cabinet-finish-weathered-oak/p-SPM1102545015; known at least as early as Mar. 31, 2016; 3 pgs.

Clive Flip Top Hunt Table; As found at website: http://luxehomecompany.com/product/clive-flip-top-hunt-table/; known at least as early as Mar. 31, 2016; 3 pgs.

Bancroft Cocktail Table with Casters and Pass through Drawer; As found at website: http://www.belfortfurniture.com/item/bancroft-cocktail-table-with-casters/1753577994; known at least as early as Mar. 31, 2016; 10 pgs.

Country Flip Top Table; As found at website: http://www.antiquepurveyor.com/reproductionfurniture-consoletables-folding-p622.html; known at least as early as Mar. 31, 2016; 2 pgs.

Crosley Furniture Cambridge Sliding Top Bar Cabinet; As found at website: http://www.walmart.com/ip/20641723?wmlspartner=wlpa&adid=22222222227014938558&wl0=&wl1=g&wl2=c&wl3=40845993512&wl4=&wl5=pla&w16=78659203712&veh=sem; known at least as early as Mar. 31, 2016; 6 pgs.

Evolution Home Bar; As found at website: https://www.greatgatherings.com/bars-game-room/home-bar-collections/evolution-home-bar-with-bar-stools-collection; known at least as early as Apr. 4, 2016; 9 pgs.

Korean Bar Cabinet with Wine Storage; As found at website: http://www.wayfaircom/Oriental-Furniture-Korean-9-Bottle-Hanging-Bar-Cabinet-KRN-H-12-OFN4882.html; known at least as early as Mar. 31, 2016; 4 pgs.

* cited by examiner

CONVERTIBLE BAR CABINET

FIELD OF DISCLOSURE

The present disclosure relates to furniture. More particularly, the present disclosure relates to case goods providing a storage and counter-top function.

BACKGROUND

Functionality and multiplicity of use are becoming increasingly important aspects of furniture design. Consumers continue to seek to furnish their homes with functional pieces as formal dining rooms and formal living rooms become less common in homes. Designers, in turn, continue to develop furniture for the modern consumer with an increasing number of features and uses. Designers often seek to create mobile furniture that can be more easily moved from one location to another or from one room to the next. Furniture with variable height is also becoming popular to accommodate different users or use by individuals in different postures. Rarely anymore is the goal of a furniture piece simply to provide decorative ornamentation to a previously empty portion of a space.

There continues to be a need for furniture with multiple uses and configurations so that the owner is able to gain the most utility from their furniture.

SUMMARY

An embodiment of the present disclosure includes furniture comprising an extensible counter-top. The counter-top includes a central section with an upper support surface and a first leaf pivotable relative to the central section. The first leaf has a first support surface and a second support surface. A second leaf is pivotable relative to the central section, the second leaf has a first support surface and a second support surface. The extensible counter-top has at least a compact position and an extended position. In the compact position, the upper support surface is substantially completely hidden and an upwardly facing usable surface comprises the first support surface of the first leaf adjacent to and coplanar with the first support surface of the second leaf. In the extended position, the upwardly facing usable surface comprises the second support surface of the first leaf adjacent to and coplanar with the upper support surface, and the second support surface of the second leaf positioned to face upwardly and offset downwardly relative to the upper support surface.

In another embodiment, the present disclosure describes convertible furniture comprising a cabinet housing having at least one of a shelf and a drawer. The cabinet housing has an extensible counter-top with a primary surface and a pair of leaves hingeably attached to the cabinet housing for pivoting relative to the primary surface. In a folded position, the pair of leaves rest upon the primary surface. In an unfolded position, the pair of leaves hinge in opposite directions to expand a width of the counter-top. When in the unfolded position, a first leaf of the pair of leaves forms a first support surface substantially coplanar with the primary surface, and a second leaf of the pair of leaves forms a second support surface offset below the primary surface.

Yet another embodiment includes a bar cabinet comprising a base and a pair of leaves movable relative to the base. The base and the pair of leaves combine to form an extensible support surface having a folded position where a top of the base is covered, and an extended position where the support surface comprises usable portions thereof arranged at two different heights.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Many home owners enjoy opening their homes to guests for cocktails or a dinner party, often taking place in a dining room. A common piece of furniture placed within a dining room is a buffet, also referred to as a side-board. These pieces are often placed against one wall. As the name suggests, a buffet generally provides a top surface where food or drinks can be set out during a meal or a party. In some instances, buffets include closed storage below the top surface for holding plates, silverware, serving utensils and stemware when these items are not in-use.

Another piece of furniture that can be useful while hosting an event is a bar. A bar may be designed to use against a wall within a room. Alternatively, the bar may be designed to be positioned away from the wall, so that all sides of the bar may be accessible. Like a buffet, a bar may be configured to provide a counter-top serving area while also being configured for discrete storage of bar-related items, such as wine, stemware and cocktail mixers.

Figure 1:
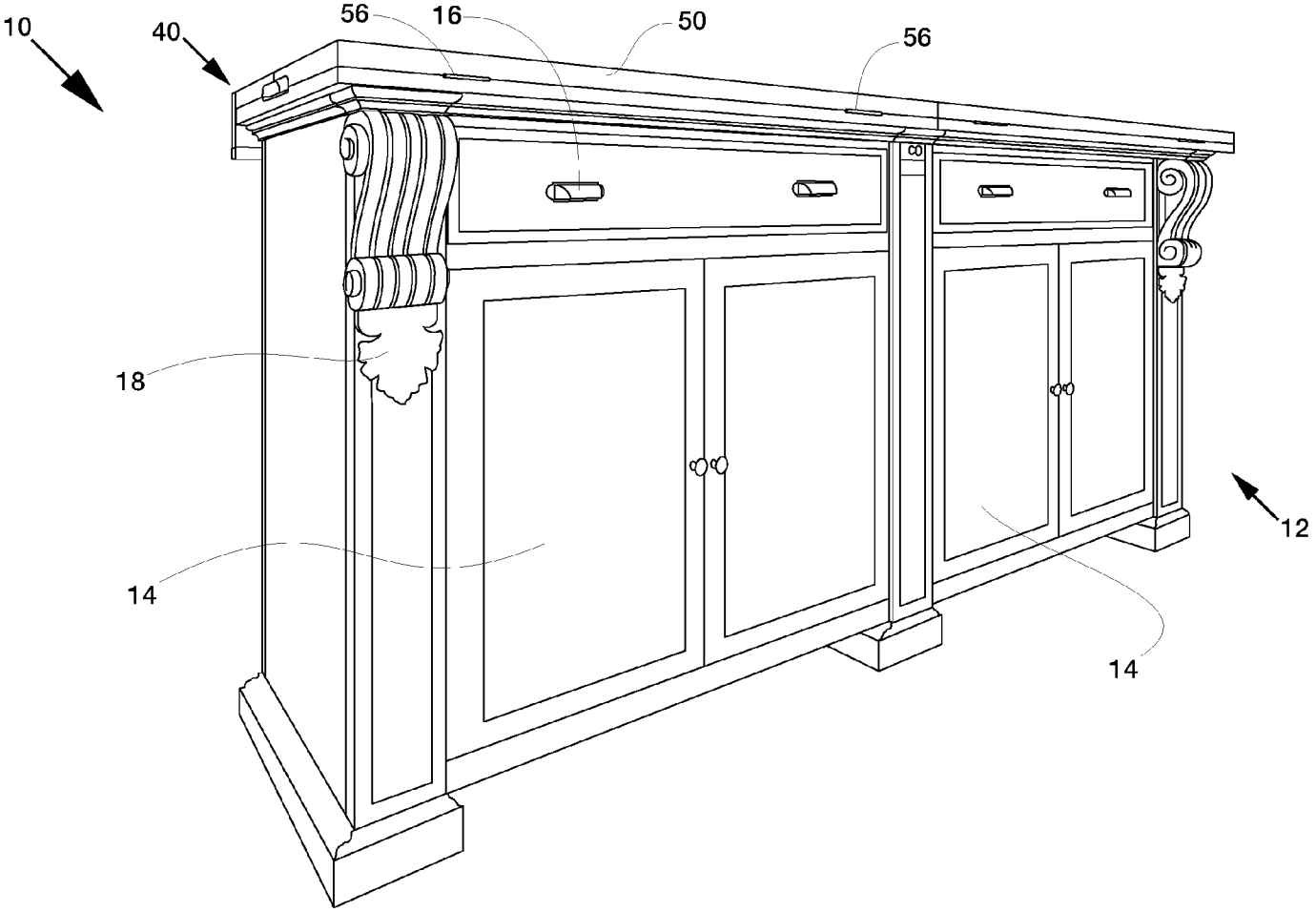
FIG. 1 is a guest-side view of a bar cabinet according to an embodiment of the present disclosure when the bar cabinet is fully closed.
Figure 2:
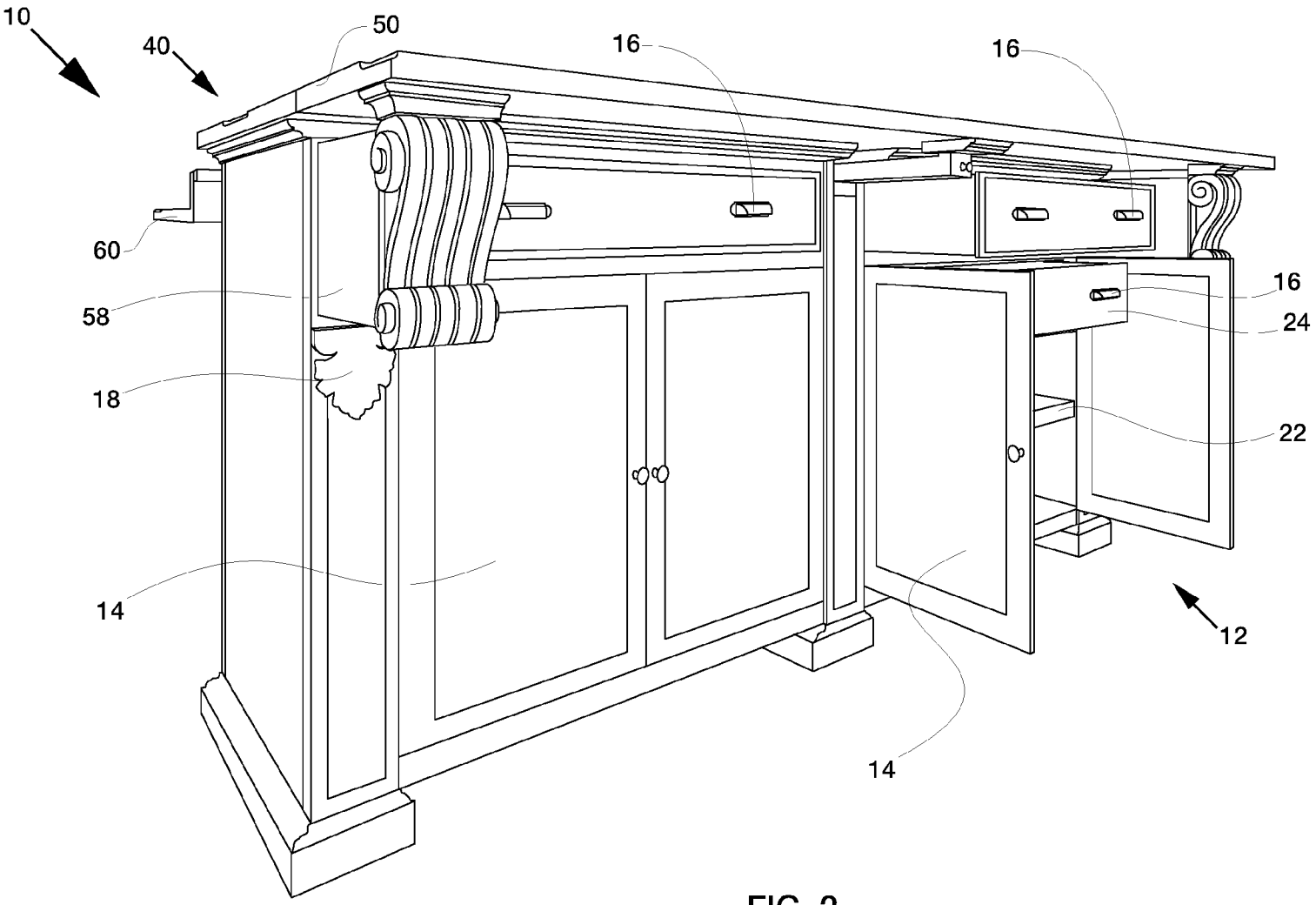
FIG. 2 is a guest-side view of the bar cabinet of FIG. 1 with open features.

FIGS. 1-6 show a bar cabinet 10 according to an embodiment of the present disclosure that is specially designed so that the bar cabinet may be used during several occasions, including acting as a buffet during a dinner party or acting as a bar during a cocktail party. FIGS. 1 and 2 show a guest-side 12 of the bar cabinet 10. The guest-side 12 with all of the illustrated features is known in FIG. 1 in a closed position, an orientation that may be prominent most of the time as the bar cabinet 10 is maintained against a wall and not in-use. FIG. 2 shows the guest-side 12 with several features in their open position to illustrate the functional aspects of one embodiment of the bar cabinet 10. The guest-side 12 is intended to be facing the guests during an event, or facing into a room if the bar cabinet 10 is positioned against a wall. The guest-side 12 presents the appearance of a well-designed case. Cabinet doors 14, drawer hardware 16 and aesthetically pleasing carved elements 18 may all contribute to the finished appearance of the guest-side 12 of the bar cabinet 10.

Figure 3:
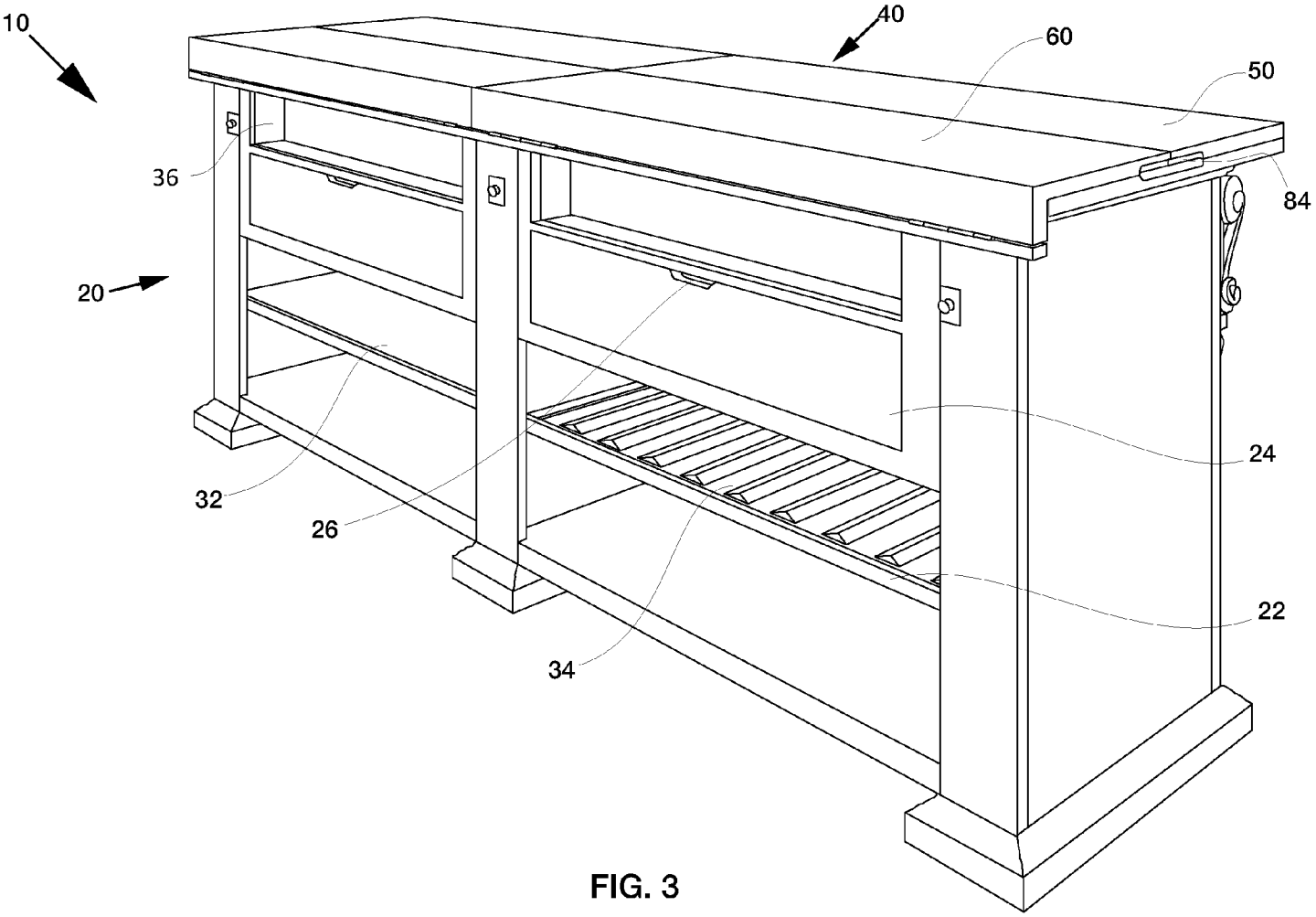
FIG. 3 is a host-side view of the bar cabinet of FIG. 1 when fully closed.
Figure 4:
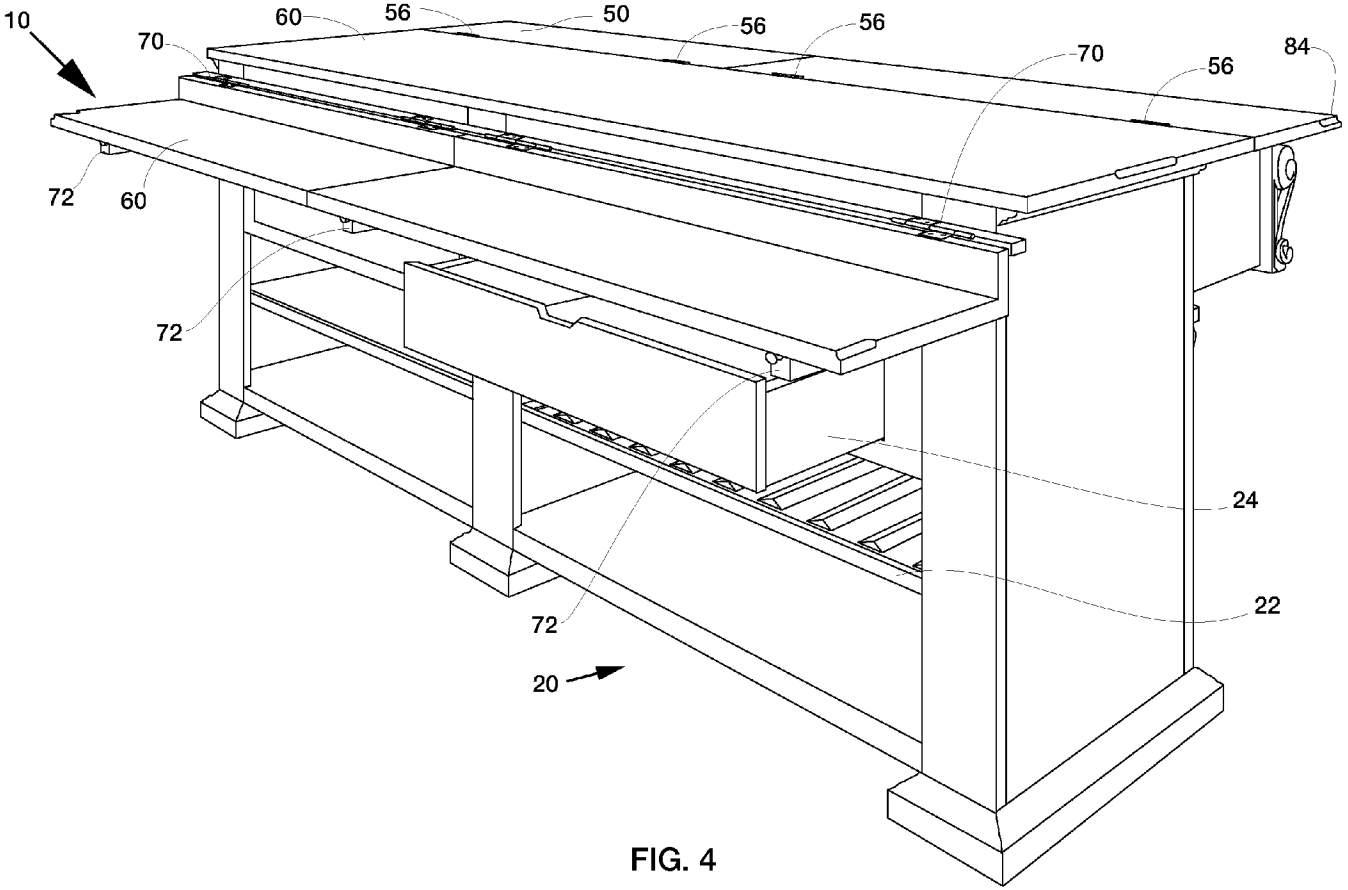
FIG. 4 is a host-side view of the bar cabinet of FIG. 1 with open features.

FIGS. 3 and 4 show a host-side 20 of the bar cabinet 10. FIG. 3 shows the host-side 20 is a closed state suitable for placement against a wall. FIG. 4 shows the host-side with open features indicative of the bar cabinet 10 in-use for serving cocktails or the like. The host-side 20 will generally face the wall if the bar cabinet 10 is positioned against a wall. The host-side 20 is also intended to be accessed by the host or others for serving drinks to the guests who may be waiting along the guest-side 12 of the bar cabinet 10. As compared to the guest-side 12, the host-side 20 is designed with a more utilitarian approach, allowing the host to more easily access stored items. For example, shelves 22 are open-access on the host-side 20. On the other hand, shelves 22 are accessed from the guest-side 12 only after opening the cabinet doors 14, as seen in FIG. 2. The host-side 20 also seeks to avoid substantial permanent projections that could force the bar cabinet 10 to sit too far from a wall. For example, instead of the drawer hardware 16 found on the guest-side 12, a drawer 24 may be accessible from the host-side 20 and pulled open by a hand slot 26.

Figure 5:
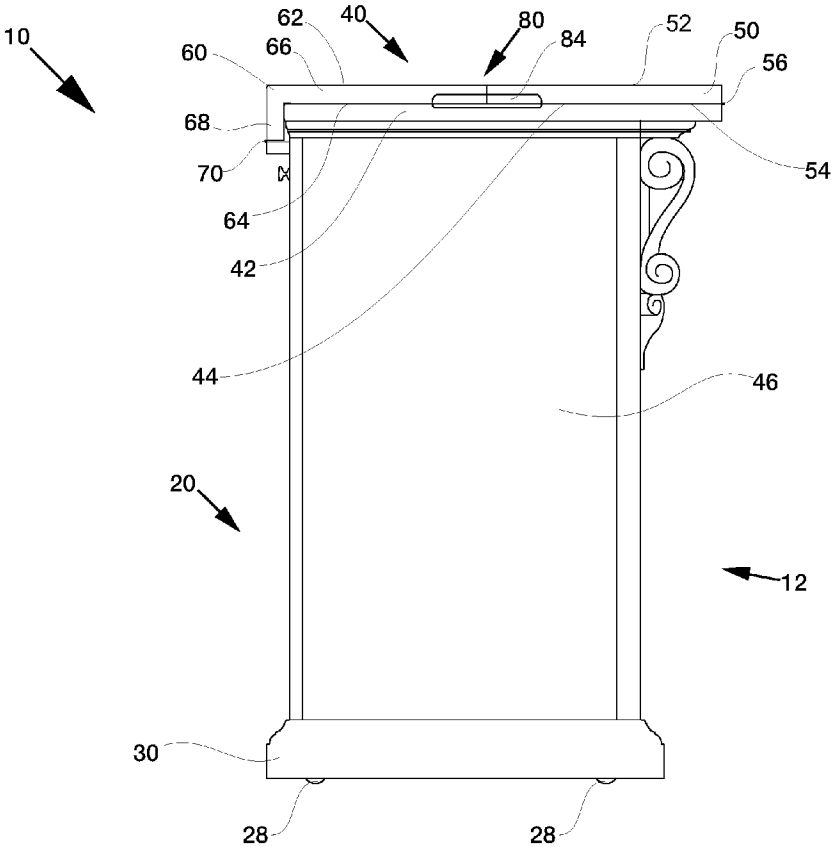
FIG. 5 is a profile view of the bar cabinet of FIG. 1 with an extensible counter-top in a folded position.

To help facilitate the ability to use the bar cabinet 10 in both a buffet configuration, positioned against a wall, as well as a bar configuration, with the bar cabinet set into the room, optional glides or wheels 28 (as shown in FIG. 5), such as casters, may be provided on the bottom 30 of the bar cabinet as seen in FIG. 5. The wheels 28 may be any type known in the art, but preferably, the wheels will have the ability to swivel up to 360 degrees. One or more of the wheels 28 may be provided with an ability to lock in place. Additionally or alternatively, the wheels 28 may be configured to retract so that the bottom 30 of the bar cabinet 10 rests upon the floor. The wheels 28 may also be adjustable in height, so that the wheels not only facilitate portability of the bar cabinet 10, but also help level the bar cabinet.

As seen in FIG. 3, the bar cabinet 10 may have one or more shelves 22. The shelves 22 may be removable from the bar cabinet from at least the host-side 20. The shelves 22 may be removed so that the number and spacing of the shelves 22 can be configured to the owner's preferences. In one embodiment, the shelves 22 are also reversible. Each shelf 22 may be inserted with a smooth side 32 facing upward as seen in FIG. 3. The smooth side 32 may support any number of items in a traditional manner. Alternatively, the shelf 22 may be inserted with a textured side 34 facing upward. The textured side 34 may be configured to limit movement of a substantially cylindrical object (e.g. a wine bottle) lying on its side.

The bar cabinet 10 may also have a mixing niche 36 on the host-side 20 above the drawers 24 to allow for quick access to mixing tools and glasses as well as temporary stowage of used glasses when either half of the flip-top is left closed. The mixing niche 36 may be lined with laminate for ease of clean up, and to protect the wood structure of the cabinet 10.

As seen in FIGS. 2 and 4, the drawer 24 may be a pass-through drawer. In other words, the same drawer 24 may accessed and pulled out from both the guest-side 12 (when the cabinet door 14 is open) as well as from the host-side 20. Use of a pass-through type drawer maximizes the usable storage space as compared to arranging two one-sided drawers back-to-back. Similarly, the shelves 22 may be accessed from both the guest-side 12 (when the cabinet door 14 is open) as well as from the host-side 20. Therefore, the drawers 24 and the shelves 22 occupy a two-way accessible storage space to increase the usability of the bar cabinet 10. The optional wheels 28 help move the bar cabinet 10 away from the wall, which may facilitate access to the storage space from one direction. Other optional features within the storage space may include channel type wine glass racks which hold wine glasses upside down, as known in the art.

Figure 6:
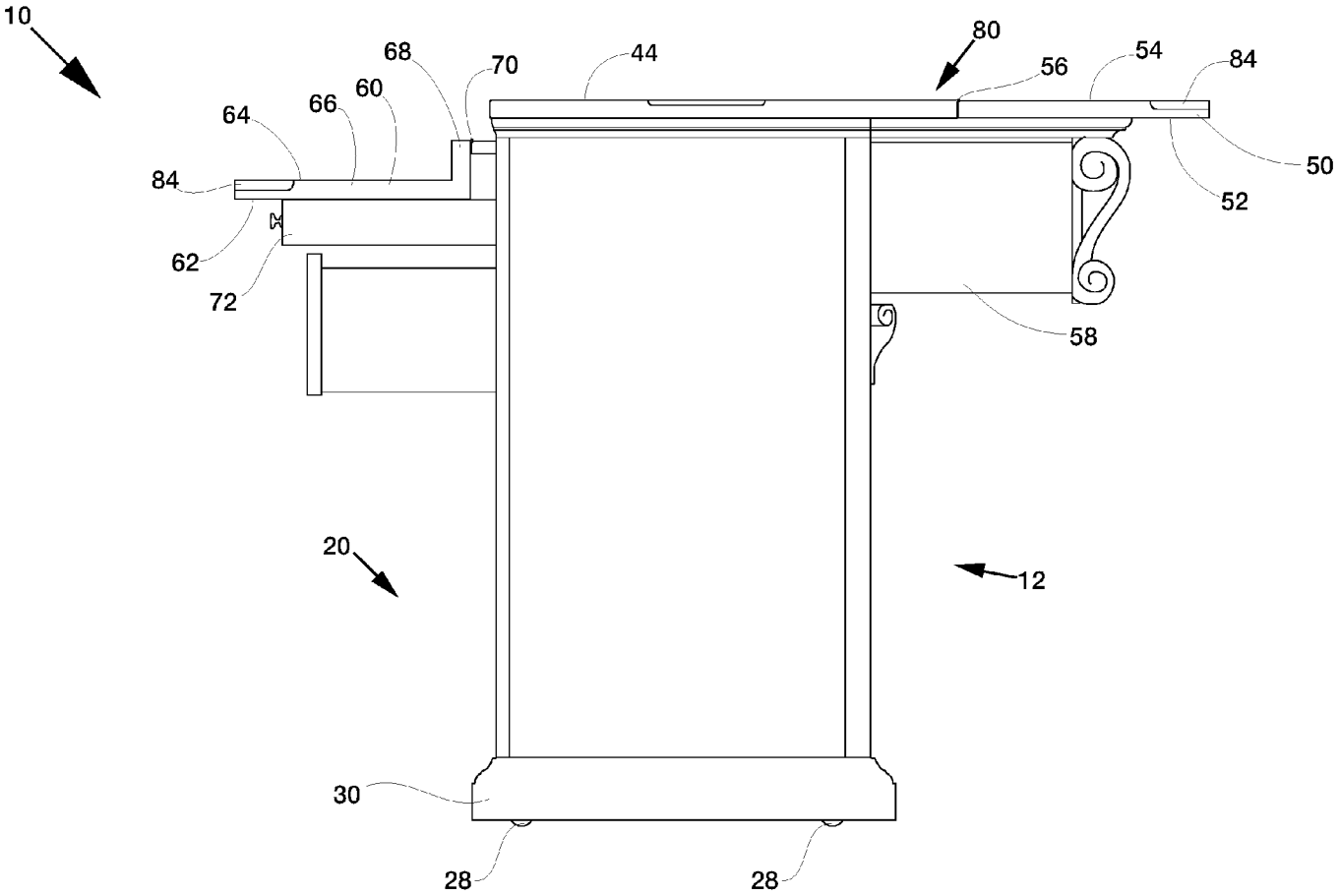
FIG. 6 is a profile view of the bar cabinet of FIG. 1 with the extensible counter-top in an unfolded position.

Turning to FIGS. 5 and 6, a profile view of the bar cabinet 10 may best illustrate an extensible counter-top 40 in a folded and unfolded position respectively. The extensible counter-top 40 includes a central section 42 with a primary upper support surface 44. The central section 42 and primary upper support surface 44 are generally formed by the top of the main cabinet housing 46. The cabinet housing 46 mat also be referred to as the base of the bar cabinet 10.

At least one first leaf 50 is hinged to the cabinet housing 46 be pivotable relative to the central section 42. The at least one first leaf 50 is associated with the guest-side 12 of the bar cabinet 10 to extend outwardly therefrom in the unfolded position. A single first leaf 50 may extend substantially the full length of the guest-side 12. In other embodiments, two or more first leaves 50 combine to cover the length of the guest-side 12. Plural first leaves 50 may be preferred to avoid each first leaf being too heavy, and to increase the number of configurations available for the extensible counter-top 40. The first leaf 50 has a first support surface 52 and a second support surface 54. The first leaf 50 may be plate shaped, e.g. substantially planar, and hinged by first hinges 56 at a first location substantially along the upper support surface 44. In a folded position, the first leaf 50 may rest upon and at least partially cover the upper support surface 44. One or more guest-side braces 58 selectively extend (e.g. slide out) from the guest-side 12 to support the first leaf 50 in an unfolded position.

The extensible counter-top 40 also includes at least one second leaf 60 hingeably attached to the cabinet housing 46 be pivotable relative to the central section 42. The at least one second leaf 60 is associated with the host-side 20 of the bar cabinet 10 to extend outwardly therefrom in the unfolded position. A single second leaf 60 may extend substantially the full length of the host-side 20. In other embodiments, two or more second leaves 60 combine to cover the length of the host-side 20. Plural second leaves 60 may be preferred to avoid each second leaf being too heavy, and to increase the number of configurations available for the extensible counter-top 40.

The second leaf 60 also has a first support surface 62 and a second support surface 64. The second leaf 60 may be L-shaped as shown, with a first leg 66 having the first and second support surfaces 62, 64 and a second leg 68 hinged to the cabinet housing 46 with second hinges 70 at a second location offset below the upper support surface 44. In a folded position, the second leaf 60, particularly the first leg 66, may rest upon and at least partially cover the upper support surface 44. One or more host-side braces 72 (e.g. corbels) selectively extend (e.g. slide out) from the host-side 20 to support the second leaf 60 in an unfolded position with the second support surface 64 facing upwardly. In one embodiment, the second support surface 64 of the second leaf 60 may include a urethane laminate or other liquid resistant coating to protect the second support surface from beverages spilled during preparation.

FIG. 5 shows a fully compact, i.e. folded, position of the extensible counter-top 40. In the fully compact position, the upper support surface 44 is substantially completely hidden below the first leaf 50 and the second leaf 60 when the bar cabinet 10 is viewed from above. An upwardly facing usable surface 80 is formed by the first support surface 52 of the first leaf 50 being positioned adjacent to and coplanar with the first support surface 62 of the second leaf 60.

FIG. 6 shows a fully extended, i.e. unfolded, position of the extensible counter-top 40. To transition from the fully compact to the fully extended position, the first and second leaves 50, 60 hinge in opposite directions to expand the width of the extensible counter-top 40. As used herein, the width of the extensible counter-top 40 corresponds with a minor axis of the bar cabinet 10 when viewed from the top, whereas the length of the extensible counter-top 40 corresponds with a major axis of the bar cabinet 10 when viewed from the top. To increase the ease of unfolding, at least one of the first and second leaves 50, 60 may include a recess 84 along an edge thereof to act as a finger grip to assist unfolding.

In the fully extended position, the upwardly facing usable surface 80 is formed by the second support surface 54 of the first leaf 50 being positioned adjacent to and coplanar with the upper support surface 44. Further, the second support surface 64 of the second leaf 60 is positioned to face upwardly, and is offset downwardly relative to the upper support surface 44. Therefore, the fully extended position provides a usable support surface with portions arranged at different heights. The bar cabinet 10 may be designed such that the upper support surface 44 is at a height of between about forty and forty-four inches, a comfortable height for standing guests to receive their drinks. When in-use, the second support surface 64 of the second leaf 60 may be provided at a height of approximately thirty-six inches or between about thirty-four inches and about thirty-eight inches, a comfortable height for a host to prepare drinks.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. An article of furniture, comprising:

an extensible counter-top having:

a central section with an upper support surface;

a first leaf pivotable relative to the central section, the first leaf having a first support surface and a second support surface; and a second leaf pivotable relative to the central section, the second leaf having a first support surface and a second support surface, wherein the extensible counter-top has at least a compact position and an extended position, and in the compact position:

the upper support surface is substantially completely hidden and an upwardly facing usable surface comprises the first support surface of the first leaf adjacent to and coplanar with the first support surface of the second leaf; and in the extended position, the upwardly facing usable surface comprises:

the second support surface of the first leaf adjacent to and coplanar with the upper support surface, and the second support surface of the second leaf positioned to face upwardly and offset downwardly relative to the upper support surface.

2. The furniture of claim 1, further comprising wheels to facilitate portability.

3. The furniture of claim 1, further comprising at least one reversible shelf.

4. The furniture of claim 3, wherein the reversible shelf has a smooth side and a textured side, the textured side configured to limit movement of a substantially cylindrical object lying on its side by the shelf.

5. The furniture of claim 1, further comprising a pass-through drawer.

6. The furniture of claim 1, wherein each leaf further comprises a recess along an edge thereof to assist with unfolding.

7. A convertible article of furniture, comprising:

a cabinet housing having at least one of a shelf and a drawer, the cabinet housing having an extensible counter-top with a primary surface and a pair of leaves hingeably attached to the cabinet housing for pivoting relative to the primary surface, wherein in a folded position, the pair of leaves rest upon the primary surface;

wherein in an unfolded position, the pair of leaves hinge in opposite directions to expand a width of the counter-top;

wherein when in the unfolded position, a first leaf of the pair of leaves forms a first support surface substantially coplanar with the primary surface and a second leaf of the pair of leaves forms a second support surface offset below the primary surface.

8. The convertible furniture of claim 7, further comprising wheels to facilitate portability.

9. The convertible furniture of claim 7, further comprising at least one reversible shelf.

10. The convertible furniture of claim 9, wherein the reversible shelf has a smooth side and a textured side, the textured side configured to limit movement of a substantially cylindrical object lying on its side by the shelf.

11. The convertible furniture of claim 7, further comprising a pass-through drawer.

12. The convertible furniture of claim 7, wherein each leaf further comprises a recess along an edge thereof to assist with unfolding.

* * * * *